US005652973A

United States Patent [19]

Blue

[11] Patent Number: 5,652,973

[45] Date of Patent: Aug. 5, 1997

[54] SHOWER HEAD HOLDING DEVICE

[76] Inventor: Dara M. Blue, 1230 Junipeo Ave., Redwood, Calif. 94061

[21] Appl. No.: 522,070

[22] Filed: Aug. 31, 1995

[51] Int. Cl.[6] ..... A47K 3/20

[52] U.S. Cl. ..... 4/570; 4/615; 248/229.26; 248/230.7; 248/289.11

[58] Field of Search ..... 4/567–570, 615; 239/283; 248/220.22, 229.26, 230.7, 231.81, 789.11, 316.7

[56] References Cited

U.S. PATENT DOCUMENTS

| | | | |
|---|---|---|---|
| 1,279,006 | 9/1918 | Rose | 4/568 |
| 2,689,995 | 9/1954 | Smith | 248/230.7 X |
| 3,404,410 | 10/1968 | Sumida | 4/615 |
| 4,174,822 | 11/1979 | Larsson | 4/615 X |
| 5,481,765 | 1/1996 | Wang | 4/567 |

FOREIGN PATENT DOCUMENTS

| | | | |
|---|---|---|---|
| 1112245 | 3/1956 | France | 4/568 |

*Primary Examiner*—Charles E. Phillips

[57] ABSTRACT

A holding device for securing a shower head relative to a vertical support surface. The inventive device includes a plurality of mounting brackets securable in vertical array to a support surface. A coupling member is securable to a shower head and can be releasably coupled to any one of the mounting brackets to secure the shower head in a desired position.

6 Claims, 3 Drawing Sheets

SHOWER HEAD HOLDING DEVICE

BACKGROUND OF THE INVENTION

1. Field of the Invention

The present invention relates to shower head mounting structures and more particularly pertains to a shower head holding device for securing a shower head relative to a vertical support surface.

2. Description of the Prior Art

The use of shower head mounting structures is known in the prior art. More specifically, shower head mounting structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art shower head mounting structures include U.S. Pat. No. 5,239,712; U.S. Pat. No. 3,826,454; U.S. Pat. No. 5,213,267; U.S. Pat. No. 5,275,518; Design U.S. Pat. No. 341,007; and Design U.S. Pat. No. 348,720.

While these devices fulfill their respective, particular objectives and requirements, the aforementioned patents do not disclose a shower head holding device for securing a shower head relative to a vertical support surface which includes a plurality of mounting brackets securable in a vertical array to a support surface, and a coupling member securable to a shower head which can be releasably coupled to any one of the mounting brackets to secure the shower head in a desired position.

In these respects, the shower head holding device according to the present invention substantially departs from the conventional concepts and designs of the prior art, and in so doing provides an apparatus primarily developed for the purpose of securing a shower head relative to a vertical support surface in a desired orientation.

SUMMARY OF THE INVENTION

In view of the foregoing disadvantages inherent in the known types of shower head mounting structures now present in the prior art, the present invention provides a new shower head holding device construction wherein the same can be utilized for securing a shower head relative to a vertical support surface. As such, the general purpose of the present invention, which will be described subsequently in greater detail, is to provide a new shower head holding device apparatus and method which has many of the advantages of the shower head mounting structures mentioned heretofore and many novel features that result in a shower head holding device which is not anticipated, rendered obvious, suggested, or even implied by any of the prior art shower head mounting structures, either alone or in any combination thereof.

To attain this, the present invention generally comprises a holding device for securing a shower head relative to a vertical support surface. The inventive device includes a plurality of mounting brackets securable in vertical array to a support surface. A coupling member is securable to a shower head and can be releasably coupled to any one of the mounting brackets to secure the shower head in a desired position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower head holding device apparatus and method which has many of the advantages of the shower head mounting structures mentioned heretofore and many novel features that result in a shower head holding device which is not anticipated, rendered obvious, suggested, or even implied by any of the prior art tool guides, either alone or in any combination thereof.

It is another object of the present invention to provide a new shower head holding device which may be easily and efficiently manufactured and marketed.

It is a further object of the present invention to provide a new shower head holding device which is of a durable and reliable construction.

An even further object of the present invention is to provide a new shower head holding device which is susceptible of a low cost of manufacture with regard to both materials and labor, and which accordingly is then susceptible of low prices of sale to the consuming public, thereby making such shower head holding devices economically available to the buying public.

Still yet another object of the present invention is to provide a new shower head holding device which provides in the apparatuses and methods of the prior art some of the advantages thereof, while simultaneously overcoming some of the disadvantages normally associated therewith.

Still another object of the present invention is to provide a new shower head holding device for securing a shower head relative to a vertical support surface.

Yet another object of the present invention is to provide a new shower head holding device which includes a plurality of mounting brackets securable in a vertical array to a support surface, and a coupling member securable to a shower head which can be releasably coupled to any one of the mounting brackets to secure the shower head in a desired position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
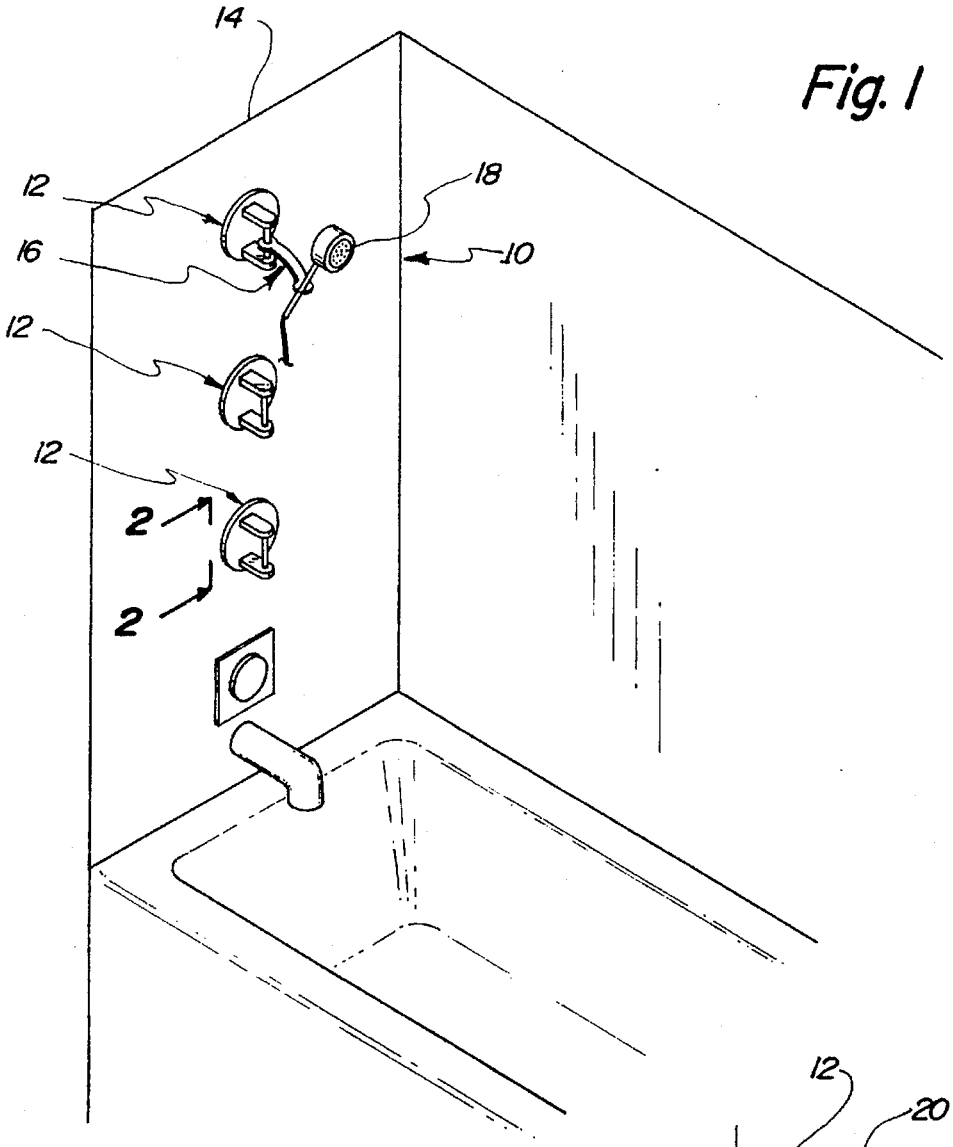
FIG. 1 is an isometric illustration of a shower head holding device according to the present invention in use.

With reference now to the drawings, and in particular to FIGS. 1–7 thereof, a new shower head holding device embodying the principles and concepts of the present invention and generally designated by the reference numeral 10 will be described.

More specifically, it will be noted that the shower head holding device 10 comprises a plurality of mounting brackets 12 which can be secured to a support surface 14 within an unlabeled shower enclosure such as is illustrated in FIG. 1 of the drawings. The mounting brackets 12 are preferably secured to the support surface 14 in a vertical array substantially as shown. An adjustable coupling means 16 is provided with the present invention for removably coupling a shower head 18 to any one of the mounting brackets 12 so as to secure the shower head relative to the support surface 14 within the shower enclosure as desired by an end user. By this structure, the shower head 18 can be adjustably positioned into a variety of orientations within the shower enclosure.

Figure 2:
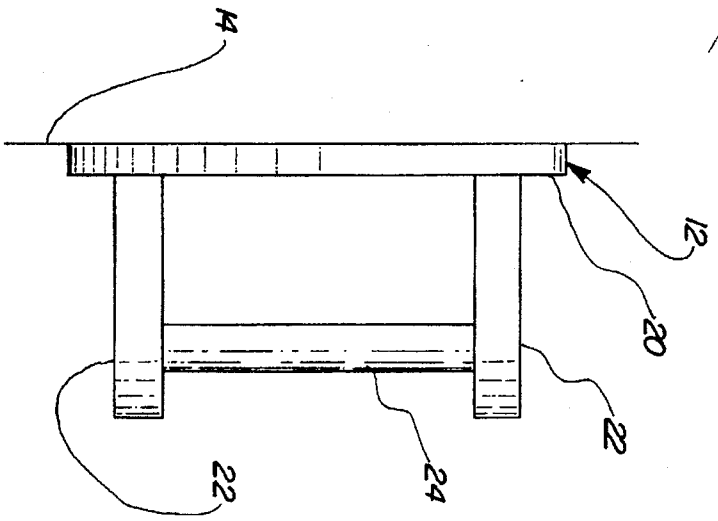
FIG. 2 is a side elevation view of an individual mounting bracket comprising a portion of the present invention as viewed from line 2—2 of FIG. 1.
Figure 3:
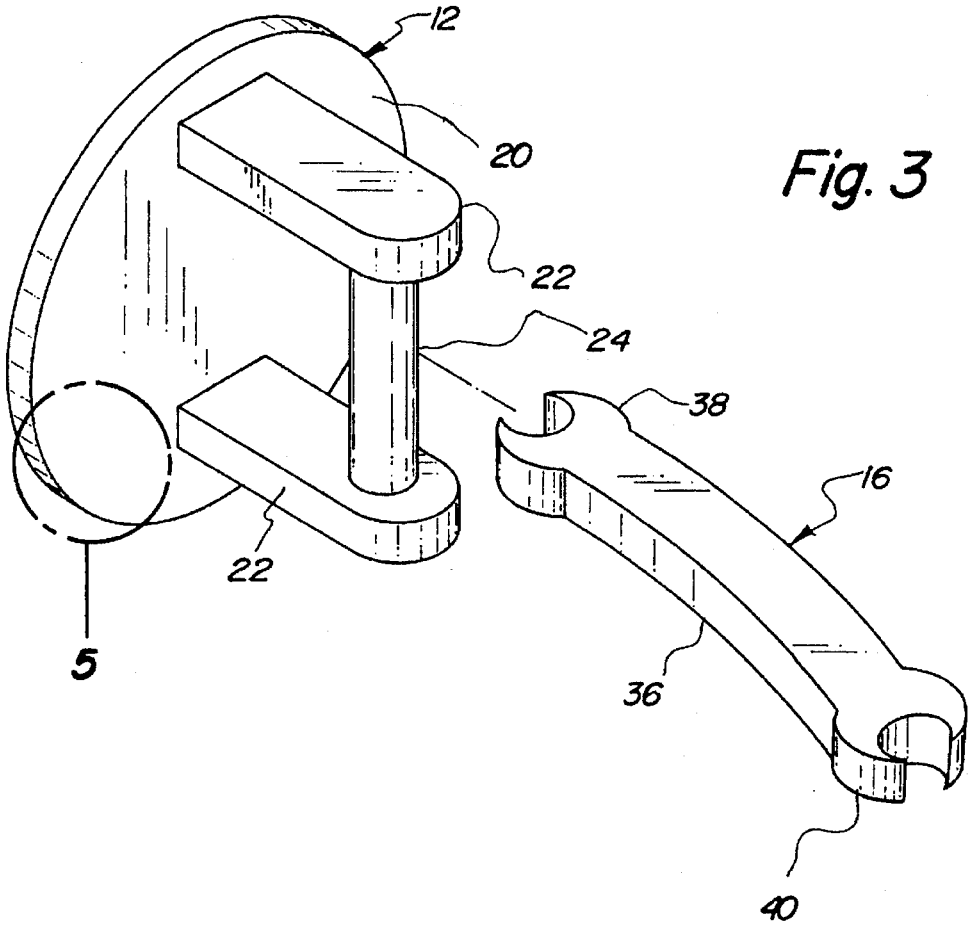
FIG. 3 is an exploded isometric illustration of the invention.
Figure 4:
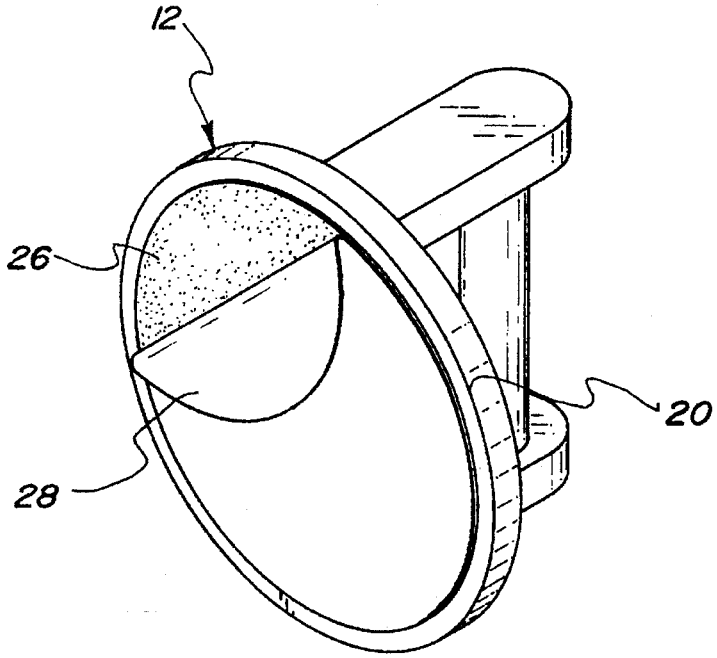
FIG. 4 is a rear isometric illustration of a mounting bracket of the invention.
Figure 5:
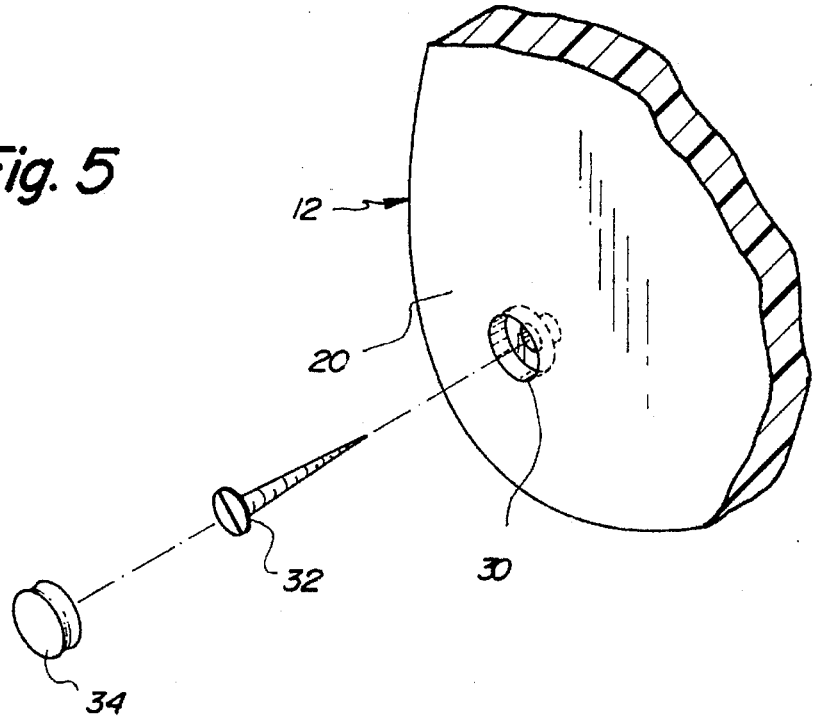
FIG. 5 is an enlarged isometric illustration of the area set forth in FIG. 3 including a recessed mounting hole directed therethrough.

Referring now to FIGS. 2 through 4, it can be shown that each of mounting brackets 12 preferably comprises a mounting plate 20 having a substantially planar rear surface which can be abuttingly positioned against the support surface 14 of the shower enclosure. A pair of support stanchions 22 project from the mounting plate 20 into a substantially spaced and parallel orientation. A vertical member 24 extends between the support stanchions 22 so as to be supported in a spaced orientation relative to the mounting plate 20 substantially as shown in FIG. 2 of the drawings. By this structure, the adjustable coupling means 16 can be secured to the vertical member 24 and adjustable positioned to a desired orientation between the support stanchions 22. Preferably, the vertical member 24 is substantially cylindrical so as to permit rotational adjustment of the coupling means 16 relative thereto. As shown in FIG. 4, the mounting brackets 12 are each preferably provided with adhesives 26 applied to a planar rear surface of the mounting plate 20 and initially covered by a removable backing 28 so as to permit for ease of adhesive securement of the mounting plate 20 of each of the mounting brackets 12 to the associated support surface 14 within a shower enclosure. Alternatively, and as shown in FIG. 5, each of the mounting brackets 12 can be shaped so as to define a recessed mounting hole 30 directed through the mounting plate 20 which permits a passage of a screw 32 through the mounting plate for engagement with the support surface 14. A plug 34 can be provided with each of the mounting brackets 12 for reception within the recessed mounting hole 30 so as to seal the same from an entrance of fluids thereinto.

Referring now to FIG. 3, it can be shown that the adjustable coupling means 16 of the present invention 10 preferably comprises an elongated stanchion 36 having a first resilient clamp 38 extending from a first end thereof and a second resilient clamp 40 extending from a second end of the elongated stanchion 36. The first resilient clamp 38 is operable to frictionally engage with the vertical member 24 of one of the mounting brackets 12. The second resilient clamp 40 operates to frictionally engage with a portion of the shower head 18 substantially as shown in FIG. 1 of the drawings. Preferably, the resilient clamps 38 and 40 are integrally formed with the stanchion 36 and comprise unlabeled cylindrical apertures directed through the respective ends of the stanchion 36, with the cylindrical apertures extending into contiguous communication with and through a portion of an outer peripheral edge of the stanchion. By this structure, the resilient clamps 38 and 40 can be snap-fitted onto the vertical member 24 and the shower head 18 to support the shower head 18 relative to the respective mounting bracket 12.

Figure 6:
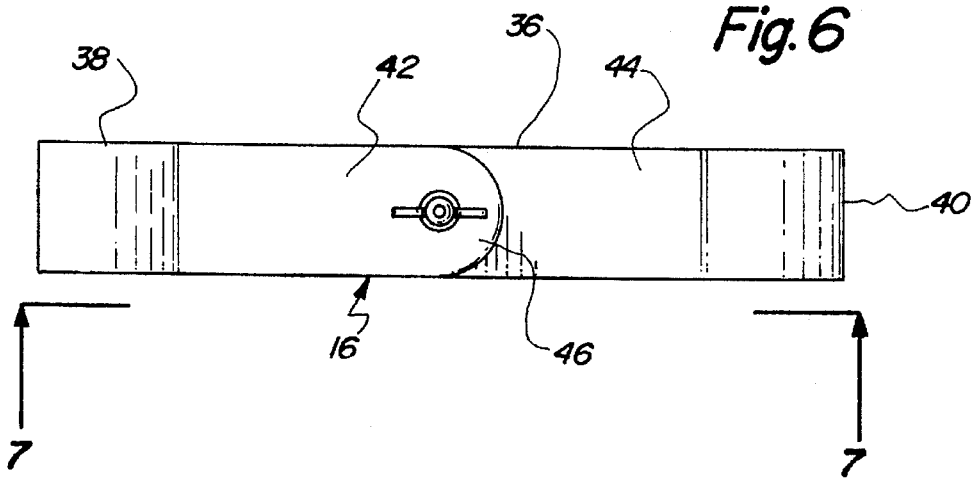
FIG. 6 is an elevation view of an alternative form of a coupling means of the present invention.
Figure 7:
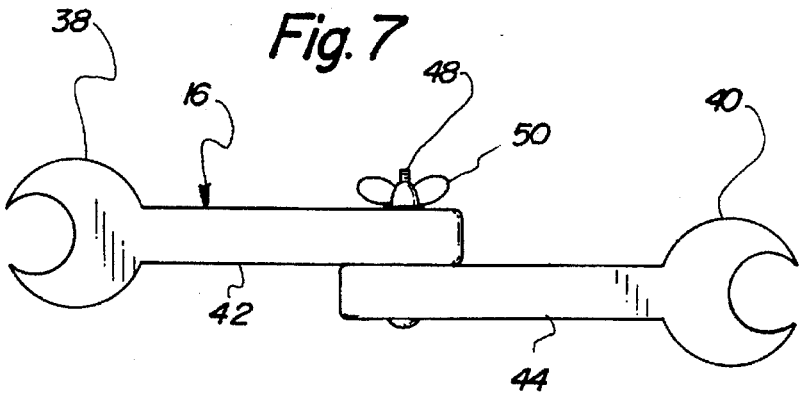
FIG. 7 is a bottom plan view of the alternative form of the coupling means as viewed from line 7—7 of FIG. 6.

Referring now to FIGS. 6 and 7, it can shown that the adjustable coupling means 16 of the present invention 10 can be configured such that the stanchion 36 is separated into a first portion 42 having the first resilient clamp 38 extending therefrom and a second portion 44 having the second resilient clamp 40 extending therefrom, with a pivotal coupling 46 extending between the first and second portions for securing the portions together in a desired pivotal orientation. To this end, and as best illustrated in FIG. 7, a threaded fastener 48 is directed through both the first and second portions 42 and 44 of the stanchion 36, with a securing nut 50 being adjustable threadably engaged to the threaded fastener for capturing and securing the portions together in a desired pivotal orientation. By this structure, the second resilient clamp 40 can be positioned into a desired orientation relative to the first resilient clamp 38 so as to position the shower head 18 at a desired angular orientation relative to the respective mounting bracket 12 as desired by an end user.

In use, the shower head holding device 10 of the present invention can be easily utilized for securing a shower head relative to a vertical support surface 14 within a shower enclosure such as is illustrated in FIG. 1 of the drawings. The plurality of mounting brackets 12 provided with the present invention 10 permit an individual to secure the mounting brackets into a desired array within the shower enclosure so as to adjustable positioning of the shower head 18 into a variety of custom configurations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shower head holding device comprising:

at least one mounting bracket which can be secured to a support surface within a shower enclosure, the at least one mounting bracket comprises a plurality of mounting brackets securable in a vertical array to the support surface, the mounting brackets each comprises a mounting plate having a substantially planar rear surface which can be abuttingly positioned against a support surface;

a pair of support stanchions projecting from the mounting plate of the mounting brackets into a substantially spaced orientation relative to one another;

a vertical member extending between the support stanchions so as to be supported in a spaced orientation relative to the mounting plate of the mounting brackets;

an adjustable coupling means for removably coupling a shower head to the at least one mounting bracket so as to permit securement of the shower head relative to the support surface within the shower enclosure, the adjustable coupling means comprises and elongated stanchion having a first resilient clamp extending from a first end thereof and a second resilient clamp extending from a second end of the elongated stanchion, the first resilient clamp being frictionally engaged with the vertical member of one of the mounting brackets, with the second resilient clamp being frictionally engagable with a portion of a shower head, the adjustable coupling means can be secured to the vertical member and adjustable positioned to a desired orientation between the support stanchions; and the resilient clamps are integrally formed with the stanchion and comprise cylindrical apertures directed through the respective ends of the stanchion, with the cylindrical apertures extending into contiguous communication with and through a portion of an outer peripheral edge of the stanchion such that the resilient clamps can be snap-fitted onto the respective vertical member and a shower head to support the shower head relative to the respective mounting bracket.

2. The shower head holding device of claim 1, wherein the stanchion of the adjustable coupling means is separated into a first portion having the first resilient clamp extending therefrom, and a second portion having the second resilient clamp extending therefrom, and further comprising a pivotal coupling extending between the first and second portions for securing the portions together in a desired pivotal orientation.

3. The shower head holding device of claim 2, wherein the a threaded fastener is directed through both the first and second portions of the stanchion, with a securing nut being adjustable threadably engaged to the threaded fastener for capturing and securing the portions together in a desired pivotal orientation.

4. A shower head holding device comprising:

a shower enclosure having a support surface;

a shower head;

at least one mounting bracket secured to the support surface within the shower enclosure, the at least one mounting bracket comprises a plurality of mounting brackets secured in a vertical array to the support surface of the shower enclosure, the mounting brackets each comprises a mounting plate having a substantially planar rear surface abuttingly positioned against and secured to the support surface;

the mounting brackets each have a pair of support stanchions and a vertical member, the support stanchions projecting from the mounting plate into a substantially spaced orientation relative to one another, the vertical member extending between the support stanchions so as to be supported in a spaced orientation relative to the mounting plate;

an adjustable coupling means for removably coupling the shower head to the at least one mounting bracket so as to secure the shower head relative to the support surface within the shower enclosure, the adjustable coupling means can be secured to the vertical member and adjustably positioned to a desired orientation between the support stanchions, the adjustable coupling means comprises and elongated stanchion having a first resilient clamp extending from a first end thereof and a second resilient clamp extending from a second end of the elongated stanchion, the first resilient clamp being frictionally engaged with the vertical member of one of the mounting brackets, with the second resilient clamp being frictionally engaged with a portion of the shower head;

the vertical member is substantially cylindrical so as to permit rotational adjustment of the coupling means relative thereto; and the resilient clamps are integrally formed with the stanchion and comprise cylindrical apertures directed through the respective ends of the stanchion, with the cylindrical apertures extending into contiguous communication with and through a portion of an outer peripheral edge of the stanchion such that the resilient clamps can be snap-fitted onto the respective vertical member and a shower head to support the shower head relative to the respective mounting bracket.

5. The shower head holding device of claim 4, wherein the stanchion of the adjustable coupling means is separated into a first portion having the first resilient clamp extending therefrom, and a second portion having the second resilient clamp extending therefrom, and further comprising a pivotal coupling extending between the first and second portions for securing the portions together in a desired pivotal orientation.

6. The shower head holding device of claim 5, wherein the a threaded fastener is directed through both the first and second portions of the stanchion, with a securing nut being adjustable threadably engaged to the threaded fastener for capturing and securing the portions together in a desired pivotal orientation.

* * * * *